US010065385B2

(12) United States Patent
Hartung

(10) Patent No.: US 10,065,385 B2
(45) Date of Patent: Sep. 4, 2018

(54) COMPACTING DEVICE FOR COMPACTING CONTAINER

(71) Applicant: WINCOR NIXDORF INTERNATIONAL GMBH, Paderborn (DE)

(72) Inventor: Domenic Hartung, Molsdorf (DE)

(73) Assignee: Wincor Nixdorf International GMBH, Paderborn, DE (US)

( * ) Notice: Subject to any disclaimer, the term of this patent is extended or adjusted under 35 U.S.C. 154(b) by 1007 days.

(21) Appl. No.: 14/446,868

(22) Filed: Jul. 30, 2014

(65) Prior Publication Data

US 2015/0033961 A1 Feb. 5, 2015

(30) Foreign Application Priority Data

Jul. 31, 2013 (EP) ..... 13178779

(51) Int. Cl.
*B30B 1/30* (2006.01)
*B30B 9/32* (2006.01)
(Continued)

(52) U.S. Cl.
CPC ..... *B30B 9/321* (2013.01); *B30B 1/30* (2013.01); *B30B 9/325* (2013.01); *B30B 12/00* (2013.01);
(Continued)

(58) Field of Classification Search
CPC ..... B30B 1/30; B30B 12/00; B30B 15/30; B30B 15/32; B30B 15/068; B30B 9/321;
(Continued)

(56) References Cited

U.S. PATENT DOCUMENTS 2,920,554 A * 1/1960 Bunke ..... B02C 1/04 100/215
3,951,059 A * 4/1976 Morris ..... B30B 9/325 100/172
(Continued)

FOREIGN PATENT DOCUMENTS

AT 228371 7/1963
GB 115258 4/1918
(Continued)

*Primary Examiner* — Jimmy T Nguyen
(74) *Attorney, Agent, or Firm* — Black, McCuskey, Souers & Arbaugh, LPA

(57) ABSTRACT

A compacting apparatus (1) for compacting receptacles has a compacting unit (3) with at least one first advancing device (4) for transporting at least one receptacle (G) in an insertion direction (E). The compacting unit (3) is configured to compact the receptacle (G) while the receptacle (G) is transported in the insertion direction (E). A post-compacting unit (5) is downstream of the compacting unit (3) in the insertion direction (E) and has at least one second advancing device (6) for transporting the at least one receptacle (G) through the post-compacting unit (5). The post-compacting unit (5) is configured to compact the at least one receptacle (G) further. Positions of the at least one first advancing device (4) of the compacting unit (3) and the at least one second advancing device (6) of the post-compacting unit (5) are changeable with respect to one another in the insertion direction (E).

14 Claims, 14 Drawing Sheets

(51) Int. Cl.

| | |
|---|---|
| ***B30B 12/00*** | (2006.01) |
| ***B30B 15/30*** | (2006.01) |
| ***B30B 15/06*** | (2006.01) |
| ***B30B 15/32*** | (2006.01) |

(52) U.S. Cl.
CPC ..... *B30B 15/068* (2013.01); *B30B 15/30* (2013.01); *B30B 15/32* (2013.01); *Y10S 100/902* (2013.01)

(58) Field of Classification Search
CPC ..... B30B 9/325; Y10S 100/902; B26F 1/24; B26F 2210/11
See application file for complete search history.

(56) References Cited

U.S. PATENT DOCUMENTS

| | | | | |
|---|---|---|---|---|
| 4,995,314 | A * | 2/1991 | Buer | B30B 9/321 100/152 |
| 5,522,311 | A * | 6/1996 | Horsrud | B26F 1/24 100/152 |
| 5,890,424 | A * | 4/1999 | Deters | B30B 9/325 100/110 |
| 6,571,695 | B1 * | 6/2003 | Holmen | B26F 1/24 100/151 |
| 6,796,225 | B1 * | 9/2004 | Henrysson | B29B 17/0052 100/152 |

FOREIGN PATENT DOCUMENTS

| | | |
|---|---|---|
| GB | 1127252 | 9/1968 |
| JP | 2000-15487 | 1/2000 |
| JP | 2005-111552 | 4/2005 |

* cited by examiner

COMPACTING DEVICE FOR COMPACTING CONTAINER

BACKGROUND

1. Field of the Invention

The invention relates to a compacting apparatus for compacting receptacles.

2. Description of the Related Art

A compacting apparatus for compacting receptacles comprises a compacting unit which has at least one first advancing device for transporting at least one receptacle in an insertion direction. The compacting unit is configured to compact the at least one receptacle while it is being transported in the insertion direction. The compacting apparatus further comprises a post-compacting unit arranged downstream of the compacting unit in the insertion direction, said post-compacting unit having at least one second advancing device for transporting the at least one receptacle through the post-compacting unit, wherein the post-compacting unit is configured to compact the at least one receptacle further.

Such a receptacle may be for example a disposable plastics bottle (such as a PE or PET bottle) or a beverage can.

A compacting apparatus of the type in question here is used in particular in conjunction with a reverse vending machine via which a consumer can deliver empties, for example in a shop, in exchange for the refund of a deposit. A reverse vending machine in this case accepts empties in the form of receptacles, for example disposable plastics bottles or beverage cans, and feeds this receptacle to a compacting apparatus that compacts the receptacle.

In the context of this text, the term "compacting" is understood to mean the reduction in volume of a receptacle. Compacting serves firstly to allow space-saving storage and easy, cost-effective transport of receptacles as a result of the reduction in volume. Secondly, in accordance with requirements for example of the Deutsche Pfandsystem GmbH (DPG), upon the return of receptacles the receptacle itself or check markings attached to the receptacle should be destroyed such that it is not possible to return the receptacle to a noncompacted state and thus to insert the receptacle into a reverse vending machine again.

DE 101 14 686 C1 discloses an apparatus in which a receptacle is fed via a vane shaft to a spiked roller that bears spikes in order to irreversibly perforate the receptacle.

DE 10 2006 033 615 A1 discloses a compacting apparatus in which a receptacle is fed to a roller that bears blades on its outer lateral surface in order to perforate and destroy an introduced receptacle.

In the case of a compacting apparatus known from DE 2009 049 070 A1, provision is made of two rollers which have rotation axes that extend parallel to one another. The rollers bear strips that extend in an undulating manner on their outer lateral surfaces, said strips being intended to serve to improve the draw-in behavior for receptacles and compacting.

JP 2005-111552 A discloses a compacting apparatus having two chain drives which convey a receptacle in an advancing direction and as a result compact it. The compacting apparatus acts in this case unidimensionally in that the receptacle is conveyed between the diametrically opposed advancing devices. An input hopper is arranged above the compacting apparatus and has a feed opening into which receptacles are inserted. Compacting does not take place by means of the hopper, merely feeding.

Known compacting apparatuses are frequently constructed in a multistage manner nowadays, in that a post-compacting unit follows a precompacting unit. Such compacting apparatuses generally act unidimensionally, in that receptacles are pressed flat in one spatial direction and in the process are destroyed. This results in a comparatively complicated multistage construction with a considerable installation space requirement.

In addition, in conventional compacting apparatuses, as a result of the manner of destruction of the receptacle during compacting, sharp corners and edges frequently form on compacted receptacles, these sharp corners and edges having the effect that receptacles catch on and interlock with one another in a container into which the receptacles are introduced, this resulting in an unfavorable bulk handling and layering behavior with the result that compacted receptacles cannot readily be distributed favorably in a container.

There is a need for a compacting apparatus that allows both a high compacting rate and a high compacting factor, that is to say a large volume reduction, while having simultaneously reliable operation with a long service life.

The compacting rate, that is to say the maximum number of compactable receptacles per minute, in this case determines the overall performance of a receptacle return system, because a reverse vending machine downstream of which there is a single compacting apparatus can accept receptacles only at the speed at which the downstream compacting apparatus can compact the receptacles.

It is the object of the present invention to provide a compacting apparatus that allows efficient operation with a high compacting rate and a high compacting factor.

SUMMARY OF THE INVENTION

According to one aspect of the invention, the positions of the at least one first advancing device of the compacting unit and of the at least one second advancing device of the post-compacting unit are changeable with respect to one another in the insertion direction.

The invention is based on the idea of configuring a compacting apparatus for multistage compacting with a compacting unit and a post-compacting unit arranged downstream of the compacting unit. A receptacle inserted into the compacting apparatus is first of all transported through the compacting unit and compacted there in a first stage. From the compacting unit, the receptacle passes into the post-compacting unit arranged downstream of the compacting unit and is compacted further there.

One or more advancing devices are provided in each of the compacting unit and the post-compacting unit to ensure that the receptacle is advanced in the insertion direction and to transport the receptacle first through the compacting unit and then through the post-compacting unit. Since the positions of the at least one first advancing device of the compacting unit and the at least one second advancing device of the post-compacting unit are changeable with respect to one another in the insertion direction, a receptacle conveyed from the compacting unit to the post-compacting unit can be compressed between the compacting unit and the post-compacting unit. Thus, it is possible to run the at least one first advancing device of the compacting unit and the at least one second advancing device of the post-compacting unit for example at different speeds, such that a receptacle is conveyed for example more quickly by the compacting unit to the post-compacting unit than the post-compacting unit can discharge the receptacle. This has the effect that the receptacle is compressed between the compacting unit and the post-compacting unit, wherein, on account of the variability of the position of the at least one first advancing device and the at least second advancing device with respect to one another, the distance between the at least one first advancing device and the at least one second advancing device is changeable and thus the volume of a compression space located between the advancing devices is variable.

The fact that the positions of the at least one first advancing device of the compacting unit and the at least one second advancing device of the post-compacting unit are changeable with respect to one another in the insertion direction should be understood here as meaning that the overall positions of the at least one first advancing device and the at least one second advancing device can be adapted to one another in the vertical direction in the insertion direction. The distance between the at least one first advancing device and the at least one second advancing device in the insertion direction is thus variable and changeable.

The changeability of the position should in particular not be understood as meaning that an advancing means of the at least one first advancing device or of the at least one second advancing device, for example a chain of a chain drive, can be driven and adjusted during normal operation. Such an adjustment that brings about an advancing movement is not accompanied by a change in position of the advancing devices with respect to one another. The distance between the advancing devices in the insertion direction does not change as a result.

Such an apparatus for compacting current disposable receptacles that require a deposit can be realized for example with a weight of less than 40 kg, with the result that, for the installation or replacement of the apparatus in for example a reverse vending machine, the fitter does not require lifting tools for fitting. The compacting apparatus allows, at a high compacting rate, and a compacting factor, wherein at the same time a compacted receptacle can have a form that makes the receptacle readily suitable for bulk handling.

Advantageously, the compacting unit can have a first housing on which the at least one advancing device is arranged, and the post-compacting unit can have a second housing on which the at least one second advancing device is arranged. The positions of the first housing and the second housing can then be changeable with respect to one another in the insertion direction, such that the positions of the first housing and the second housing are variable with respect to one another overall. The first housing (of the compacting unit) and the second housing (of the post-compacting unit) can thus be adjusted with respect to one another by way of the advancing devices arranged thereon such that during a compacting operation and compression of a receptacle between the compacting unit and the post-compacting unit that takes place during said compacting operation, the first housing and the second housing can be moved relative to one another in the insertion direction. The size of a compression space between the compacting unit and the post-compacting unit is thus variable and, when a receptacle is conveyed into this compression space, can be enlarged, this being able to substantially increase the efficiency of a compacting operation and in particular also allowing receptacles having different wall thicknesses (having thin wall thicknesses and having thick wall thicknesses) to be compacted equally with a high efficiency and high compacting factor.

In order to allow adjustability of the first housing and of the second housing relative to one another in a defined manner, the first housing of the compacting unit and the second housing of the post-compacting unit preferably are guided longitudinally together in the insertion direction.

The first housing and the second housing can in this case be pretensioned relative to one another by means of a spring-elastic pretensioning device. The spring-elastic pretensioning device counteracts a deflection for example of the second housing of the post-compacting unit from a starting position. In the starting position, the first housing and the second housing can be for example in the vicinity of one another. During a compacting operation, in which a receptacle is conveyed by the compacting unit into a compression space between the compacting unit and the post-compacting unit, forces that cause the first housing of the compacting unit and the second housing of the post-compacting unit to be moved apart can occur, this having to take place counter to the pretensioning forces of the pretensioning device, however. The pretensioning forces thus allow a variable expansion of the compression space depending on the volume of the receptacle conveyed into the compression space and at the same time contribute to compacting by the action of force on the receptacle. The pretensioning device in this case also restores the housing to its starting position following a compacting operation, such that the housings can be automatically brought back into the vicinity of one another following a compacting operation.

In this connection, it should be noted that it is irrelevant for the realization of the present invention whether the first housing of the compacting unit or the second housing of the post-compacting unit or both the first housing and the second housing are adjusted. What is essential is merely that the positions of the first housing of the compacting unit and the second housing of the post-compacting unit are adjustable relative to one another.

In an advantageous configuration, the at least one first advancing device of the compacting unit and the at least one second advancing device of the post-compacting unit form a compression space between one another. This should be understood as meaning that between the at least one first advancing device and the at least one second advancing device there is a space into which the compacting unit conveys a receptacle and from which the post-compacting unit discharges the receptacle. The space is not necessarily physically closed off but is merely bounded by the advancing devices and optionally by additional bounding means such that it can effectively compress a receptacle conveyed into the compression space. As a result of the positions of the at least one first advancing device and of the at least one second advancing device being changed with respect to one another, the size of the compression space is changeable, such that during a compacting operation, the compression space can be enlarged by adjustment of the advancing devices with respect to one another in the insertion direction and thus by the moving apart of the advancing devices.

This makes it possible, when a receptacle is conveyed into the compression space, for the compression space initially to have a small volume into which the receptacle is pushed. In the small-volume compression space, the receptacle is compressed, wherein, when the volume of the receptacle pushed into the compression space is greater than the capacity of the storage space and can also not be compacted further by the forces that are acting, the positions of the advancing devices are changed with respect to one another in that the advancing devices are moved apart such that the volume of the compression space increases. The increase in the volume takes place in this case counter to the pretensioning forces of the spring-elastic pretensioning device, this effecting further compacting also of that part of the receptacle that is additionally conveyed into the compression space. The compacted receptacle is then discharged from the compression space by means of the post-compacting unit and is ejected from the post-compacting unit as a compacted receptacle.

The compacting apparatus preferably has a control device. The control device can in this case in particular be configured to control the conveying speeds at which the advancing devices of the compacting unit on the one hand and of the post-compacting unit on the other hand effect an advancing movement. In particular, the at least one first advancing device of the compacting unit conveys a receptacle at a first conveying speed and the at least one second advancing device of the post-compacting unit conveys a compacted receptacle out of the compression space at a second conveying speed. The first conveying speed and the second conveying speed are in this case settable and can preferably be different from one another, wherein preferably the first conveying speed is higher than the second conveying speed in order as a result to achieve an accumulation effect at the post-compacting unit.

For example it is conceivable for the first conveying speed to be ten times the second conveying speed. The first advancing device thus conveys a receptacle into the compression space between the at least one first advancing device and the at least one second advancing device at a conveying speed which greatly exceeds the conveying speed of the post-compacting unit at which the compacted receptacle is discharged from the compression space. This has the effect that a receptacle conveyed into the compression space is compressed in the compression space because it is initially held there and is not immediately discharged. On account of the reduced conveying speed of the at least one second advancing device of the post-compacting unit, the compacted receptacle is discharged in a retarded manner following compression in the compression space.

By means of the control device, the conveying speeds of the at least one first advancing device of the compacting unit and of the at least one second advancing device of the post-compacting unit can be set in a variable, desired manner. By controlling the conveying speeds, it is possible for example also to relieve an accumulation of material, in that by equalizing the conveying speed of the post-compacting unit with the conveying speed of the compacting unit, a receptacle conveyed into the compression space is also discharged immediately such that no compression takes place within the compression space.

However, in a basic setting during normal operation, for example a factor of 10 can be provided between the conveying speeds of the compacting unit and of the post-compacting unit, wherein other factors, for example a factor of 5 or a factor of 3, are conceivable and possible in principle, or a variable speed depending on different phases during a compacting operation is set.

In an advantageous configuration, provision is made of one or more first drive apparatuses for driving the at least one first advancing device, said first drive apparatuses differing from one or more second drive apparatuses which serve to drive the at least one second advancing device. The advancing devices of the compacting unit on the one hand and of the post-compacting unit on the other hand are thus driven by different drive apparatuses, wherein the speeds of the drive apparatuses can be controlled by a common control device.

Furthermore, provision can advantageously be made of a plurality of first advancing devices and also a plurality of second advancing devices. The plurality of first advancing devices can in this case be driven in a synchronous manner by one or more first drive apparatuses, wherein the synchronization between the drive apparatuses can take place mechanically or electronically. In principle, each first advancing unit can be assigned a first drive apparatus, although it is also conceivable for a plurality of first advancing devices to be assigned a single first drive apparatus which is synchronized with one or more further first drive apparatuses in order to drive further first advancing devices.

In an analogous manner, the second advancing devices can also be driven in a synchronous manner by one or more second drive apparatuses, wherein again synchronization can take place mechanically or electronically.

The at least one first advancing device and the at least one second advancing device are advantageously arranged in an offset manner with respect to one another in the circumferential direction around the insertion direction. If the compacting unit and the post-compacting unit each have a plurality of advancing devices these are arranged preferably in a staggered manner with respect to one another such that—as seen in the circumferential direction—one advancing device of the post-compacting unit is located between two first advancing devices of the compacting unit and vice versa. If for example six first advancing devices and six second advancing devices are provided, then the first advancing devices and the second advancing devices are each at an angular spacing of 60° with respect to one another. In this case, the second advancing devices are offset with respect to the first advancing devices with an angular offset of 30°.

In one specific configuration of the compacting unit, provision is made for the at least one first advancing device to be configured to convey the at least one receptacle for compacting into a hopper formed by the compacting unit, said hopper extending between an insertion opening and an ejection opening of the compacting unit and narrowing in the direction of the ejection opening.

This is based on the idea of providing one or more advancing devices on the compacting unit, said advancing devices moving a receptacle inserted into the insertion opening of the compacting unit into a hopper of the compacting unit and conveying it through the hopper, wherein, as a result of the narrowing of the hopper, compacting, that is to say a volume reduction, of the receptacle occurs. In a corresponding manner, a compacted receptacle is ejected at the ejection opening, said receptacle having a smaller volume than the originally inserted receptacle.

In the context of the present text, the fact that a hopper is formed on the compacting unit should be understood as meaning that a space into which the receptacle is conveyed in a manner driven by the at least one first advancing device narrows in a hopper-shaped manner from the insertion opening to the ejection opening. In this case, it is not absolutely necessary for a hopper having a closed outer lateral surface to be provided on the compacting unit. Rather, the hopper can also be reproduced for example by a plurality of first advancing devices, such that the first advancing devices bound a hopper-shaped space in that the first advancing devices extend along a hopper that envelops the space. It is possible for the intermediate spaces between the first advancing devices, as is intended to be explained in the following text, to be closed in this case or not.

Since, when the receptacle to be compacted is guided through the hopper, the receptacle is compressed simultaneously—specifically radially inwardly with respect to the insertion direction—in a plurality of spatial directions by means of the at least one first advancing device, multidimensional compacting occurs. As a result of suitable shaping of the hopper and configuration of the at least one advancing device, a high compacting rate with a high compacting factor can be achieved. In addition, on account of the fact that compacting is achieved by compression of a receptacle substantially radially with respect to the insertion direction, the occurrence of what is known as stress whitening on the compacted receptacle is reduced (at least compared with a compacting operation also known as "flaking" in which a receptacle is torn into individual pieces during compacting), this allowing high material proceeds in the recycling of the receptacle material.

At its end facing the insertion opening, the hopper has a first cross-sectional area and at an end facing the ejection opening a second cross-sectional area, wherein the first cross-sectional area is larger than the second cross-sectional area and the hopper thus narrows toward the ejection opening. The hopper can in this case be formed for example at least approximately in a frustoconical manner with a circular cross section that narrows toward the end facing the ejection opening. However, the hopper can also deviate from a purely conical shape and be formed for example with a polygonal, for example quadrangular, pentagonal or hexagonal cross section.

Preferably, the compacting unit has more than one, advantageously more than two, first advancing devices, which are arranged in the circumferential direction around the insertion direction around the hopper. The advancing devices are in this case advantageously arranged in a uniformly distributed manner around the hopper and preferably form the hopper themselves in that they extend along an (imaginary) lateral surface enveloping the hopper and thus reproduce the shape of a hopper.

Since, when it is inserted into the compacting unit, a receptacle is inserted into a hopper around which preferably a plurality of advancing devices are arranged, additional measures which would otherwise be necessary for centering and orienting a receptacle are superfluous. In particular, a receptacle drawn into the hopper lines up automatically and orients itself with its longitudinal axis at least approximately along the longitudinal axis of the hopper, such that centering and orientation of the receptacle take place automatically.

Advantageously, the compacting unit can have for example three, four, five or six advancing devices which are arranged around a hopper-shaped space and form the hopper between one another in this way. Provision can be made for example of six advancing devices in order to obtain advantageous, strong, reliable drawing in with a high advancing force on a receptacle. Provision can be made of five advancing devices in order to obtain a hopper which has the smallest possible cross-sectional area in the region of its narrowed end (what is known as the "release space"). The smaller the cross-sectional area at the narrowed end of the hopper, the smaller the achievable cross section of the compacted receptacle and the larger the compacting factor in the radial direction.

The one or more first advancing devices of the compacting unit are advantageously arranged at an angle to the insertion direction (corresponding to the longitudinal axis of the hopper) which may be for example between 10° and 40°, advantageously between 15° and 25°, for example 20°. This means that the first advancing devices each produce an advancing force which is not directed in the insertion direction but at an angle to the insertion direction. The advancing force in this case acts preferably along the lateral surface of the hopper into the hopper, wherein the total of the advancing forces of a plurality of first advancing devices preferably produces a resulting advancing force which is directed in the insertion direction.

The at least one first advancing device of the compacting unit ensures that the receptacles inserted into the insertion opening are conveyed into the hopper in the insertion direction and in this way are compacted in the compacting unit in a multidimensional manner by compression in particular radially to the insertion direction. Since the advancing device conveys the receptacles into the hopper, said hopper is moved into and through the hopper in the insertion direction, wherein the insertion direction corresponds to the longitudinal axis of the hopper about which the (imaginary) lateral surface of the hopper extends.

The compacting unit has preferably more than one, in particular more than two first advancing devices, which are arranged in the circumferential direction around the insertion direction around a hopper. In an analogous manner, the post-compacting unit can also have more than one, preferably more than two second advancing devices, wherein in an advantageous configuration, the number of advancing devices of the post-compacting unit corresponds to the number of advancing devices of the compacting unit. The advancing devices of the post-compacting unit, for example three, four, five, six or more advancing devices, are, in an analogous manner to the advancing devices in the compacting unit, arranged preferably equidistantly—as seen in the circumferential direction around the insertion direction.

In a specific configuration, the at least one first advancing device of the compacting unit can be formed by a chain drive formed from chain links, said change drive being configured to move, during operation of the compacting apparatus, in an advancing direction along an outer lateral surface of the hopper, such that the at least one receptacle is conveyed into the hopper in the insertion direction and in the process compacted in a multidimensional manner. The chain drive is mounted on the housing of the compacting unit via a first sprocket and a second sprocket, such that at least one portion of the chain drive extends along the outer lateral surface of the hopper and, as a result of movement in the advancing direction, brings about an advancing force on an inserted receptacle into the hopper, that is to say toward the narrowed end thereof. The sprockets are in this case arranged on the housing and are rotatable, and so the chain drive can be moved by one or both sprockets being driven.

In an analogous manner, the at least one second advancing device of the post-compacting unit can also be formed by a chain drive formed from chain links, wherein the chain drive is configured to convey the at least one receptacle further in the insertion direction, in particular out of a compression space between the at least one first advancing device of the compacting unit and the at least one second advancing device of the post-compacting unit. The second advancing devices in this case advantageously do not describe a hopper in the manner of the first advancing devices of the compacting unit, but rather a guide channel extending in the insertion direction. During conveying through this guide channel, no (substantial) further compacting takes place. Post-compacting takes place in particular in the compression space between the compacting unit and the post-compacting unit.

Preferably arranged on the at least one first advancing device and/or on the at least one second advancing device are in each case piercing tools, for example in the form of spikes, which come into operative connection with the receptacle and thus pierce the receptacle during the conveying of a receptacle through the compacting unit and then through the post-compacting unit.

Since the advancing devices act, for the purpose of advancing, on a receptacle to be compacted and in the process pierce the receptacle with a spike or some other piercing tool, sharp edges on the compacted receptacle can be avoided or at least reduced, resulting in an advantageous shape of the compacted receptacle which allows advantageous bulk handling and layering without the compacted receptacles catching on one another.

It is also possible by means of suitable piercing tools for a check marking, for example a deposit marking, attached to a receptacle, for example to a disposable plastics bottle, to be destroyed such that it is impossible for the check marking to be recycled. This can be achieved in particular in that a plurality of piercing tools are arranged on one advancing device and/or one or more piercing tools are arranged on a plurality of advancing devices such that the receptacle is irreversibly destroyed on walls of the entire receptacle.

A receptacle inserted into the compacting apparatus can be advanced efficiently by way of the piercing tools. In addition, as a result of the perforation of a receptacle by means of a suitable piercing tool during compacting, air can escape from the receptacle to be compacted and so it is easily possible to compress the receptacle.

If the at least one (first or second) advancing device is configured as a chain drive, a piercing tool can be attached in each case to the individual chain links for example at regular intervals. In this case, provision can be made for a piercing tool to be arranged only on every second chain link on the at least one first advancing device, while a piercing tool is arranged on every chain link on the at least one second advancing device. The distance between the piercing tools on the at least one first advancing device is thus twice as large as the distance between the piercing tools on the at least one second advancing device. This has the advantageous effect that, although a receptacle is conveyed reliably into the compression space between the compacting unit and the post-compacting unit, it is not unduly destroyed during compression by the piercing tools of the first advancing devices. By means of the second advancing devices of the post-compacting unit, following compression, the compacted receptacle can then be discharged from the compression space, wherein, on account of the reduced conveying speed of the second advancing devices, the risk of (excessive) destruction of a receptacle and for example the occurrence of stress whitening is reduced.

With regard to the above explanations, it should be noted that the at least one first advancing device of the compacting unit and the at least one second advancing device of the post-compacting unit do not necessarily have to be configured as chain drives. In general, advancing devices which have a traction member to be moved in an advancing direction, for example a band, a belt, a cable or the like, which is configured as a flexible element that transmits (only) tractive forces, and can advance a receptacle through a compacting unit and a post-compacting unit are conceivable and possible. By means of the first advancing devices of the compacting unit, the receptacle is conveyed into an insertion hopper by the movement of a traction member along the lateral surface of the hopper. By way of a traction member of the second advancing device of the post-compacting unit, the receptacle is then discharged in the insertion direction following compression in the compression space between the compacting unit and the post-compacting unit.

However, quite different advancing devices, for example advancing screws or advancing rollers, are also conceivable in principle.

The idea underlying the invention is intended to be explained in more detail in the following text by way of the exemplary embodiments illustrated in the figures.

DETAILED DESCRIPTION

FIGS. 1 to 13 show an exemplary embodiment of a compacting apparatus 1 which has a compacting unit 3 for conveying a receptacle G in an insertion direction E and for compacting the receptacle G in the compacting unit 3, and a post-compacting unit 5, arranged downstream of the compacting unit 3 in the insertion direction E, for compacting the receptacle G further.

The compacting unit 3 and the post-compacting unit 5 realize different units which interact to compact a receptacle G.

Figure 1:
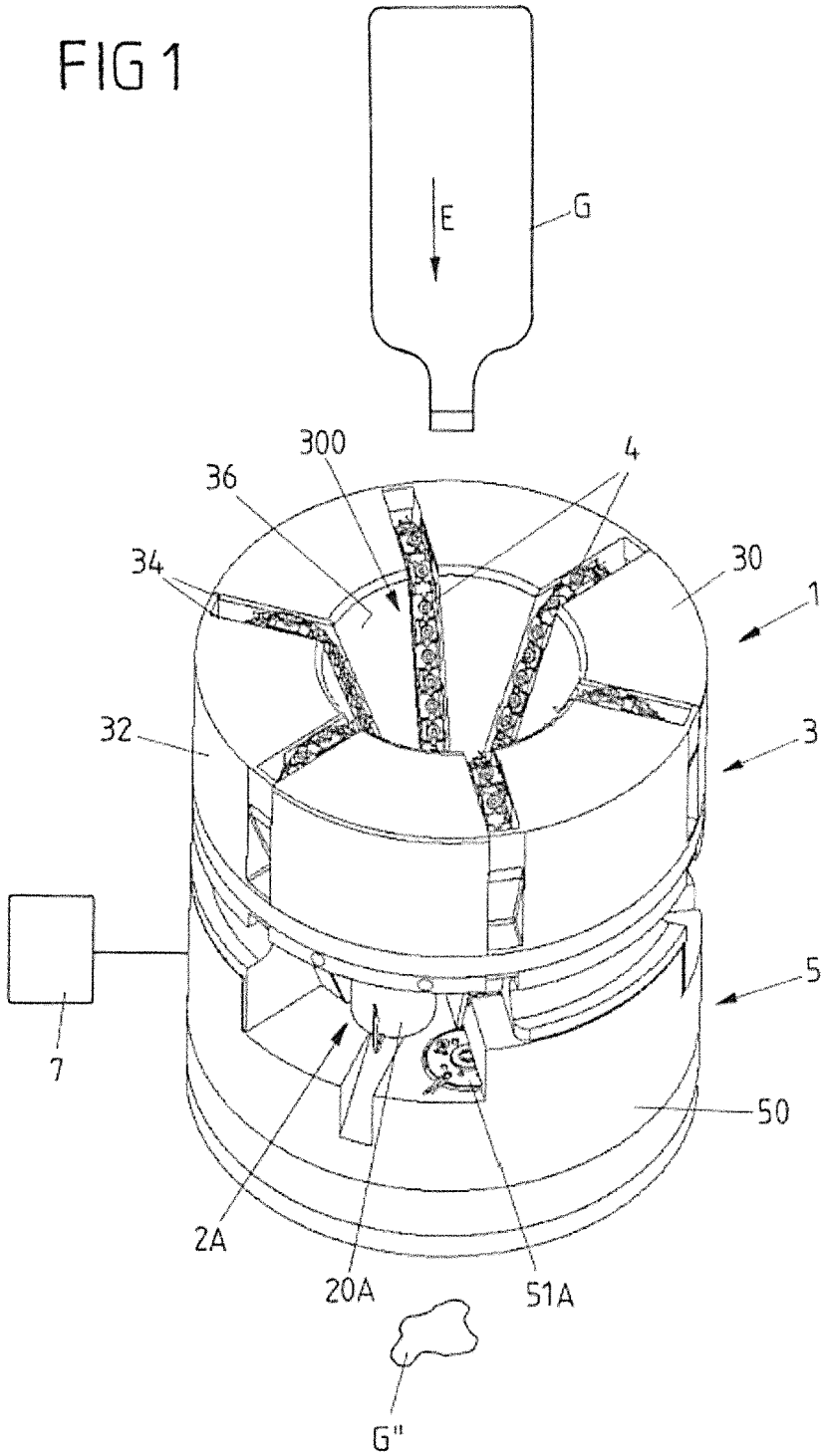
FIG. 1 is a perspective view of a compacting apparatus having a compacting unit and a post-compacting unit arranged downstream of the compacting unit.
Figure 2:
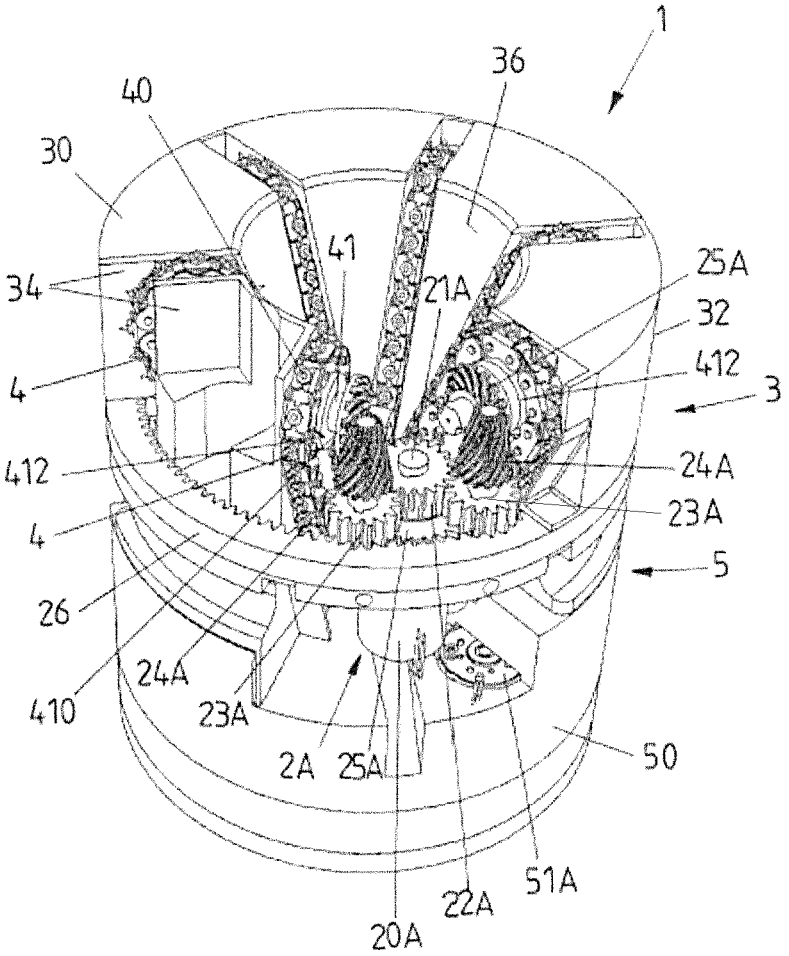
FIG. 2 is a partially cutaway perspective view of the compacting apparatus.
Figure 3:
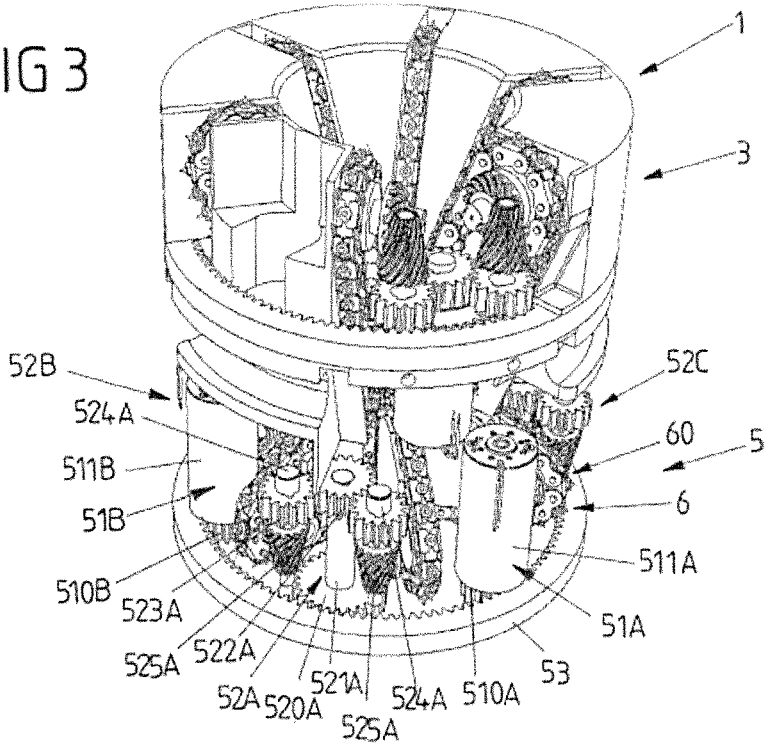
FIG. 3 is a more cutaway perspective view of the compacting apparatus.
Figure 4:
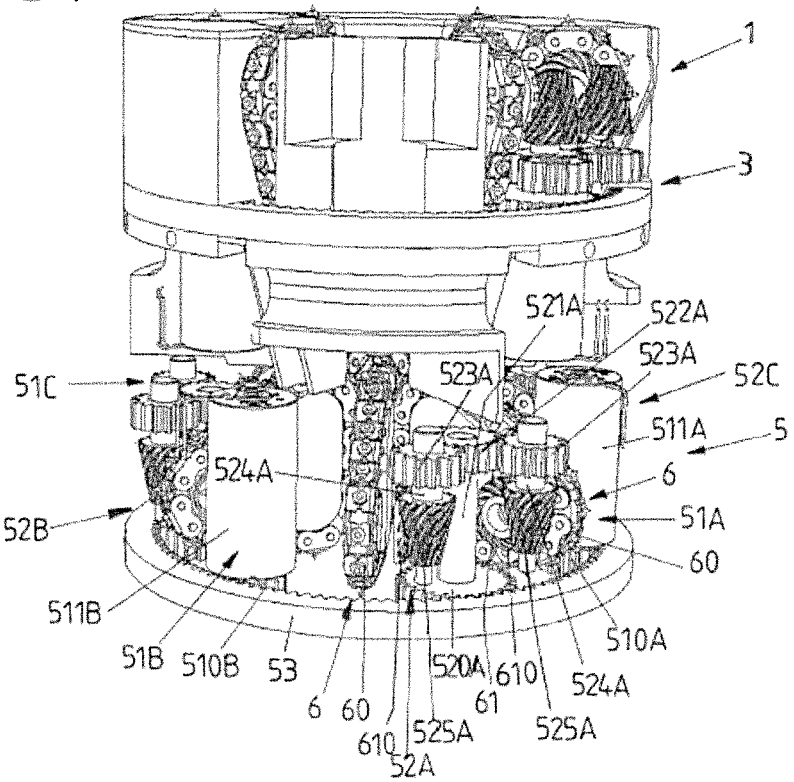
FIG. 4 is another partially cutaway perspective view of the compacting apparatus.

The compacting unit 3 has six advancing devices 4 which are formed by chain drives 40 (see FIGS. 1 and 2). The chain drives 40 are mounted on bearing plates 34 of a housing 32 via sprockets 412 and have chains that are formed from chain links 400 and are arranged on the sprockets 412. Together with guide surfaces 36, the chain drives 40 form a hopper and are intended to be driven such that a receptacle G can be inserted into the hopper through an insertion opening 300 in order to be conveyed through the compacting unit 3 by means of the chain drives 40.

Figure 14A:
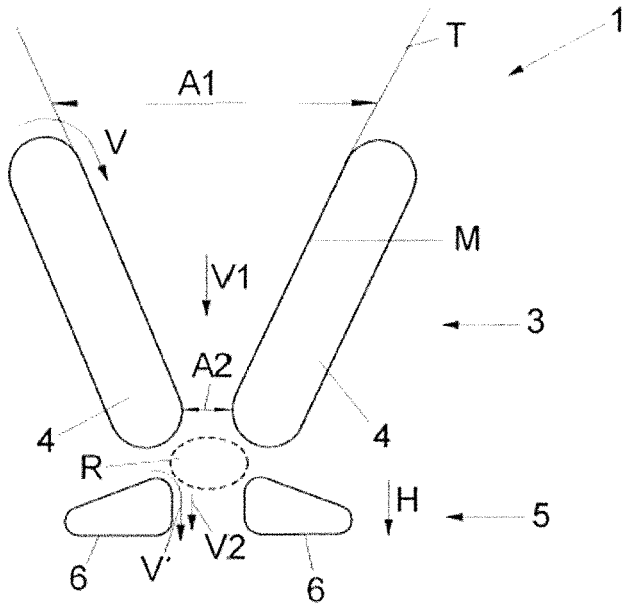
FIG. 14A is a schematic view of the advancing devices of the compacting unit and of the post-compacting unit.
Figure 14B:
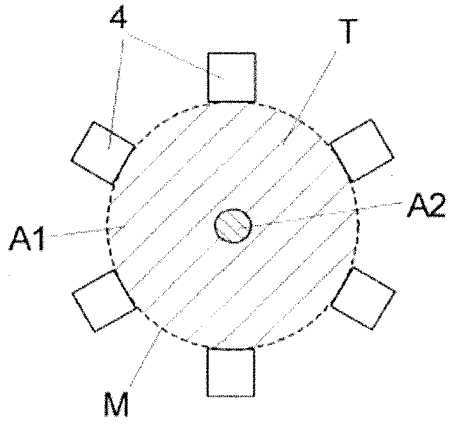
FIG. 14B is a schematic view of the compacting unit from above.
Figure 15:
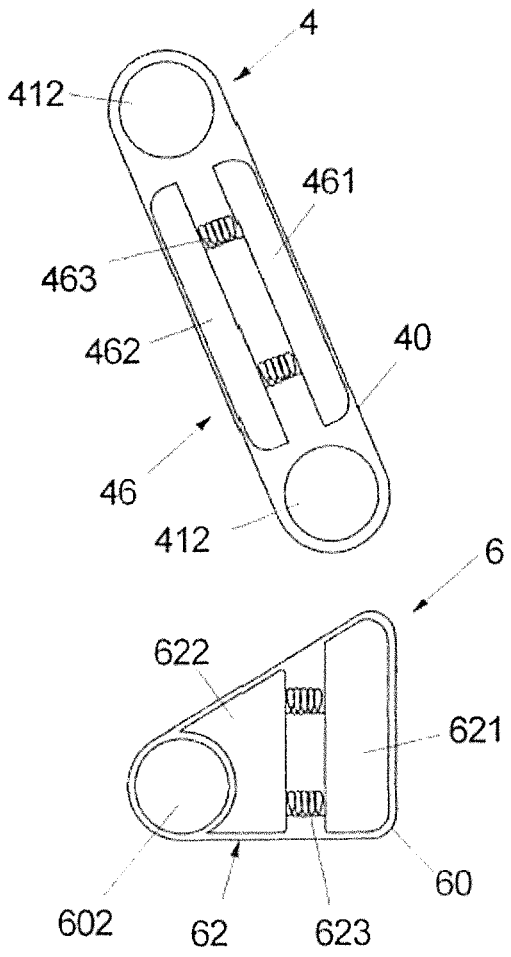
FIG. 15 is a schematic view of an advancing device of the compacting unit and an advancing device of the post-compacting unit.

The insertion opening 300 is arranged on a cover plate 30 of the housing 32 and has a cross-sectional area A1 (see FIGS. 14A and 14B). The lateral surface M, bounded by the guide surfaces 36 and the advancing devices 4 in the form of the chain drives 40, of the hopper T (see FIG. 14A) narrows in the insertion direction E down to a cross-sectional area A2 at the outlet-side end of the hopper T (see FIGS. 14A and 14B). As a result of the receptacle G being conveyed through the hopper T, the receptacle G is compacted, i.e. its volume is reduced.

In the exemplary embodiment illustrated, the compacting unit 3 has three drive apparatuses such as referenced at 2A and 2B, of which only one is visible in FIG. 2. The drive apparatuses 2A each have an electric motor 20A which drives two gear wheels 23A via a drive shaft 21A and a gear wheel 22A arranged thereon. Motor 20B of drive apparatus 2B is referenced in FIG. 13C. The gear wheels 23A are each connected firmly to a bevel wheel 24A which is in turn in interlocking engagement with a bevel wheel 410. The bevel wheel 410 is arranged on a shaft 41 of the upper sprocket 412 of an advancing device 4 and is connected firmly to the sprocket 412 via the shaft 41.

The drive shaft 20A is furthermore connected to a toothed wheel 25A which is in interlocking engagement with an internally toothed ring gear 26. The ring gear 26 extends around the compacting unit 3 and serves to synchronize the three different drive apparatuses 2A with one another in that all of the drive apparatuses 2A are coupled mechanically together via the ring gear 26 and can thus move only uniformly.

During operation, the drive shaft 21A and the gear wheel 22A arranged thereon are set into rotary movement via the electric motor 20A. As a result, the gear wheels 23A and the bevel wheels 24A connected thereto are likewise set into a rotary movement which is transmitted via the bevel wheels 410 to the shafts 41 and thus the sprockets 412 to the left and right of the bevel wheels 24A. Since the drive shaft 21A is still in interlocking engagement with the ring gear 26 via the toothed wheel 25A and as a result the movements of the drive apparatuses 2A are synchronized with one another, all of the chain drives 40 are driven in a uniform, aligned manner such that a receptacle G inserted into the insertion opening 300 in the insertion direction E is conveyed into the compacting unit 3.

Connected downstream of the compacting unit 3 is the post-compacting unit 5. As is apparent from FIGS. 3 to 6A-6C, the post-compacting unit 5 has six advancing devices 6, corresponding to the number of advancing devices 4 of the compacting unit 3, said advancing devices 6 likewise being formed by chain drives 60 having a chain composed of chain links 600. The advancing devices 6 are arranged and mounted on a housing 50 of the post-compacting unit 3, wherein each chain drive 60, as is apparent from FIG. 8, has a sprocket 602 that is in engagement with the chain formed from chain links 600, and also a guide element 62 having a guide track 620 on which the chain is guided.

Figure 6A:
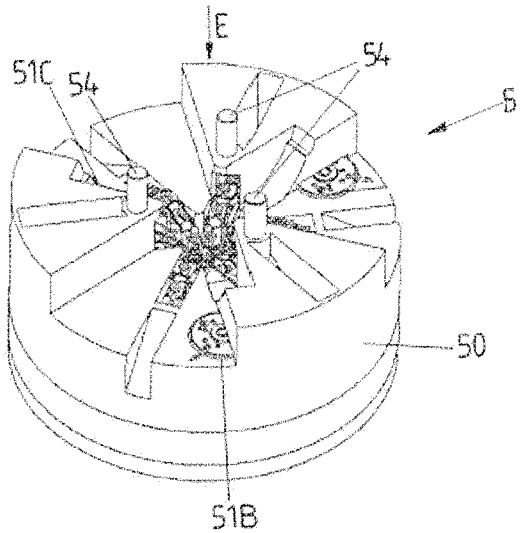
FIG. 6A is a perspective view of the post-compacting unit.
Figure 6B:
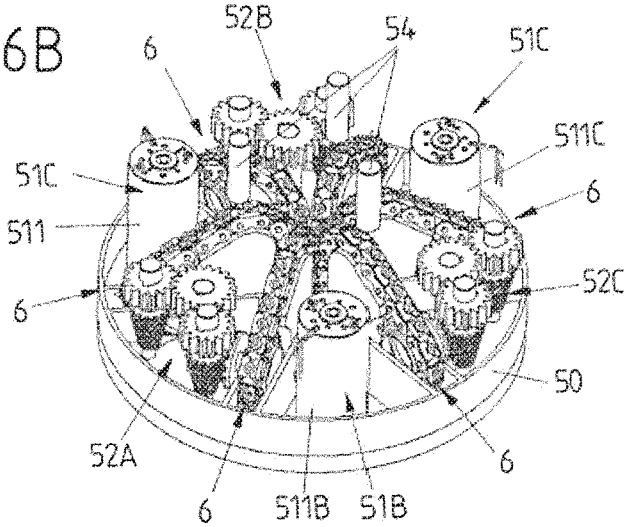
FIG. 6B is a perspective view of the post-compacting unit without a housing.
Figure 6C:
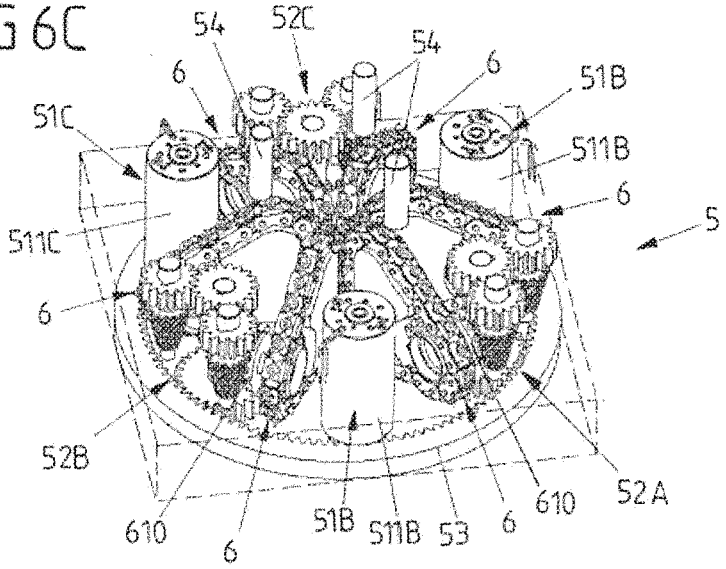
FIG. 6C is a further perspective view of the post-compacting unit without the housing.

The post-compacting unit 5 has—in an analogous manner to the compacting unit 3—three drive apparatuses 51A, 51B, 51C which each comprise an electric motor 511A, 511B, 511C (see for example FIG. 6C). The electric motors 511A, 511B, 511C are each in interlocking engagement with an internally toothed ring gear 53 via a drive wheel 510A, 510B, 510C, the drive apparatuses 51A, 51B, 51C being synchronized with one another and being operatively connected to drive trains 52A, 52B, 52C via said ring gear 53.

Each drive train 52A, 52B, 52C is assigned two advancing devices 6, wherein each drive train 52A, 52B, 52C is arranged between in each case two advancing devices 6 (as seen in the circumferential direction around the insertion direction E). Each drive train 52A, 52B, 52C has, as is apparent from FIGS. 3 to 5, a toothed wheel 520A, 520B, 520C which is arranged on a shaft 521A and is in interlocking engagement with the internally toothed ring gear 53. Arranged on the shaft 521A is a toothed wheel 522A which is engaged with two toothed wheels 523A. The toothed wheels 523A are each arranged on a shaft 524A on which a bevel wheel 525A is also held, said bevel wheel 525A being engaged with a bevel wheel 610 of the respectively assigned advancing device 6. The bevel wheel 610 is arranged on a shaft 61 and is connected via the shaft 61 to the sprocket 602 of the respective chain drive 60, such that when the bevel wheel 610 is rotated, the sprocket 602 is driven and the chain drive 60 is moved via the sprocket 602.

Figure 5:
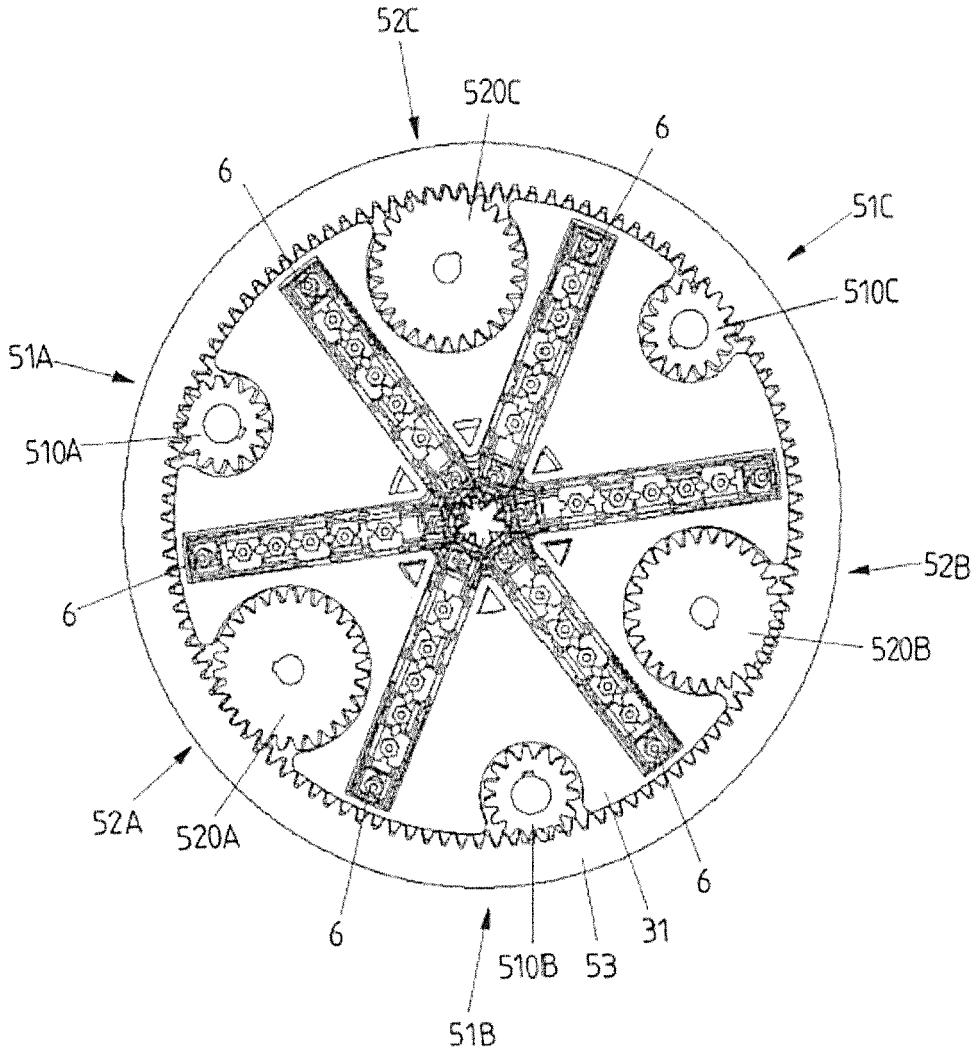
FIG. 5 is a bottom view of the compacting apparatus.

In the bottom view according to FIG. 5, the three drive wheels 510A, 510B, 510C, which are each connected to an electric motor 511A, 511B, 511C, and the toothed wheels 520A, 520B, 520C, via which the drive trains 52A, 52B, 52C are driven, can be seen.

During operation, the ring gear 53 is set into a rotary movement via the three electric motors 511A, 511B, 511C, offset with respect to one another in the circumferential direction, of the drive apparatuses 51A, 51B, 51C, and the toothed wheels 520A, 520B, 520C are driven via said rotary movement. Thus, the toothed wheels 523A and the bevel wheels 525A, which in turn drive the bevel wheels 610 and thus the sprockets 602 of the assigned chain drives 60, also move.

The advancing movement of the advancing devices 4 of the compacting unit 3 and of the advancing devices 6 of the post-compacting unit 5 are controlled via a control device 7 which is illustrated schematically in FIG. 1. The control device 7 in this case controls the conveying speeds V1, V2 (see FIG. 14A) of the advancing devices 4 of the compacting unit 3 on the one hand and of the advancing devices 6 of the post-compacting unit 5 on the other hand.

For example, the control device 7 controls the advancing devices 4 of the compacting unit 3 and the advancing devices 6 of the post-compacting unit 5 such that the conveying speed V1 of the advancing devices 4 of the compacting unit 3 is greater (for example by a factor of 10) than the conveying speed V2 of the advancing devices 6 of the post-compacting unit 5. This has the effect that a receptacle G inserted into the compacting unit 3 is conveyed through the compacting unit 3 into a compression space R between the advancing devices 4 of the compacting unit 3 and the advancing devices 6 of the post-compacting unit 5 and, on account of the reduced conveying speed V2 of the advancing devices 6 of the post-compacting unit 5, is compressed there because the receptacle G is discharged only at a reduced speed. On account of the compression, the receptacle G, which has already been compacted in a multidimensional manner in the compacting unit 3 in the radial plane transversely to the insertion direction G in a manner corresponding to the shape of the hopper T, is also compressed lengthwise in the insertion direction E, such that the receptacle G is compacted further and is reshaped to form a compact receptacle.

The advancing devices 4 are moved with their chains formed by the chain links 400 in an advancing direction V (see FIG. 14A) in order in this way to convey a receptacle G into the compacting unit. The advancing devices 6 move in an aligned manner in order to convey a receptacle G through the post-compacting unit 5 in an advancing direction V', wherein the conveying speed V1 of the compacting unit 3 and the conveying speed V2 of the post-compacting unit 5 can be different and is controlled by means of the control device 7.

Figure 7A:
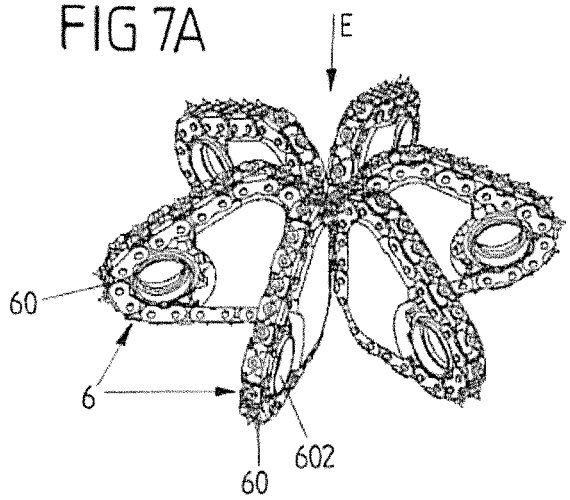
FIG. 7A is a perspective view of advancing devices of the post-compacting unit.
Figure 7B:
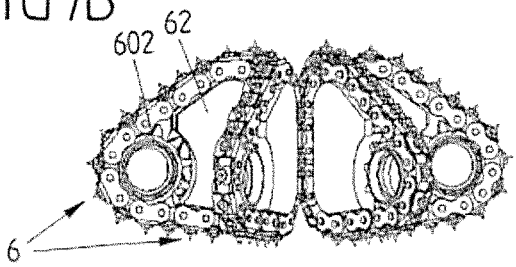
FIG. 7B is an elevational view of the advancing devices of the post-compacting unit.
Figure 8:
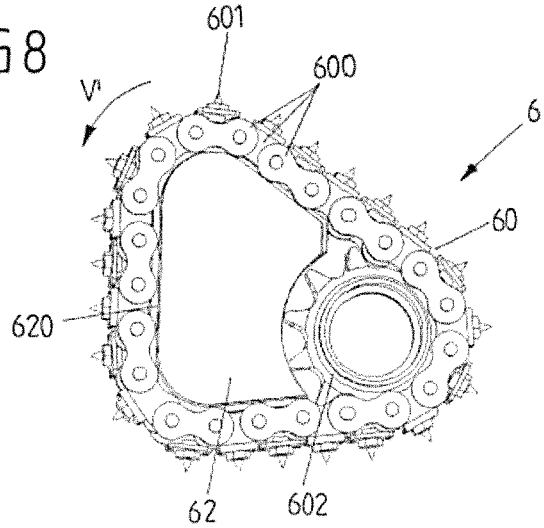
FIG. 8 is an elevational view of an advancing device in the form of a chain drive of the post-compacting unit.
Figure 9A:
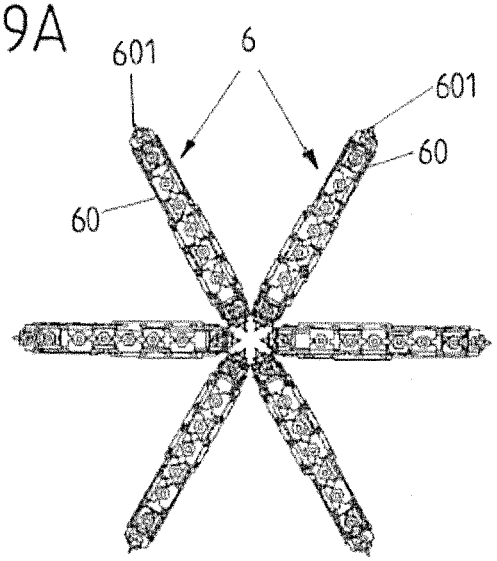
FIG. 9A is a bottom plan view of the advancing devices of the post-compacting unit.
Figure 9B:
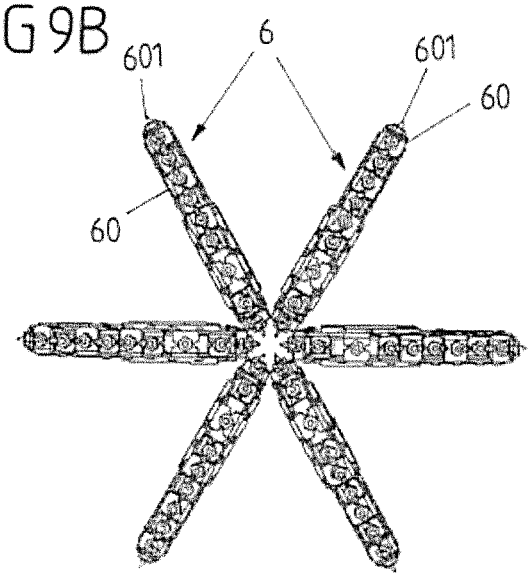
FIG. 9B is a top plan view of the advancing devices of the post-compacting unit.
Figure 10A:
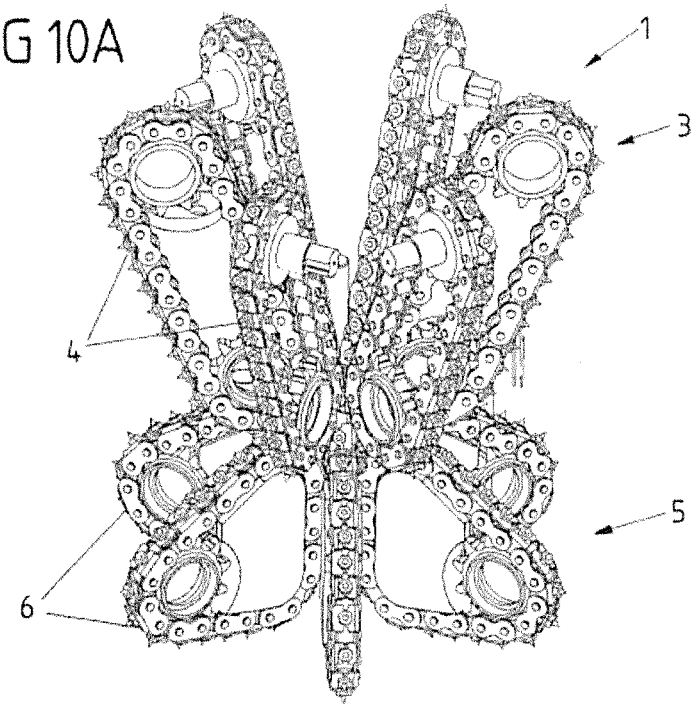
FIG. 10A is a perspective view of the advancing devices of the compacting unit and of the post-compacting unit.
Figure 10B:
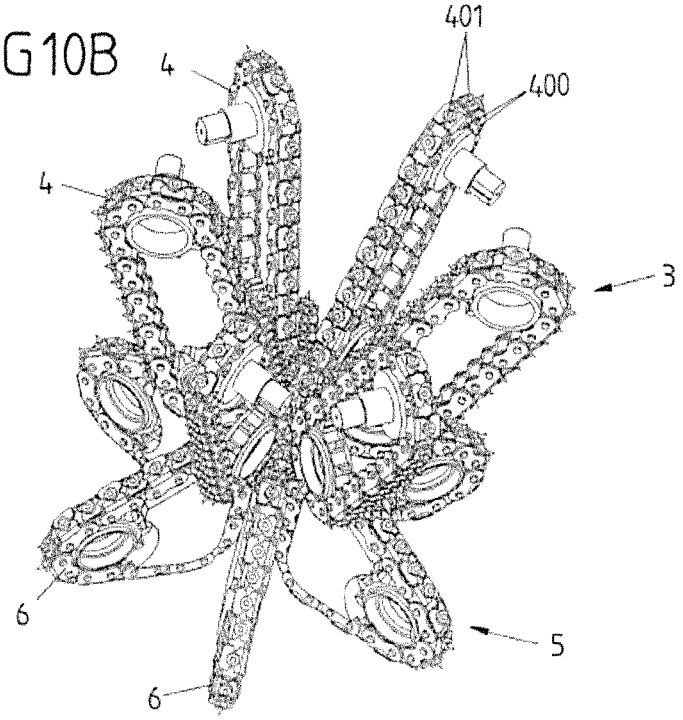
FIG. 10B is another perspective view of the advancing devices of the compacting unit and of the post-compacting unit.

As is apparent from FIGS. 7A and 7B, the advancing devices 6 of the post-compacting unit 5 are arranged at an equal spacing from one another in the circumferential direction around the insertion direction E. As is further apparent from FIGS. 10A and 10B, the advancing devices 4 of the compacting unit 3 are additionally also arranged at an equal spacing from one another in the circumferential direction, wherein the advancing devices 4 of the compacting unit 3 and the advancing devices 6 of the post-compacting unit 5 are arranged in an offset manner with respect to one another.

Figure 11A:
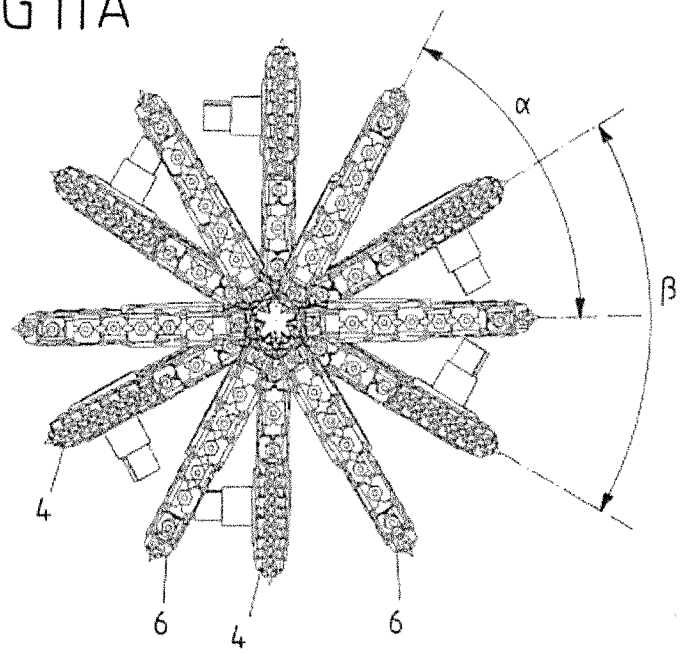
FIG. 11A is a bottom plan view of the advancing devices of the compacting unit and of the post-compacting unit.
Figure 11B:
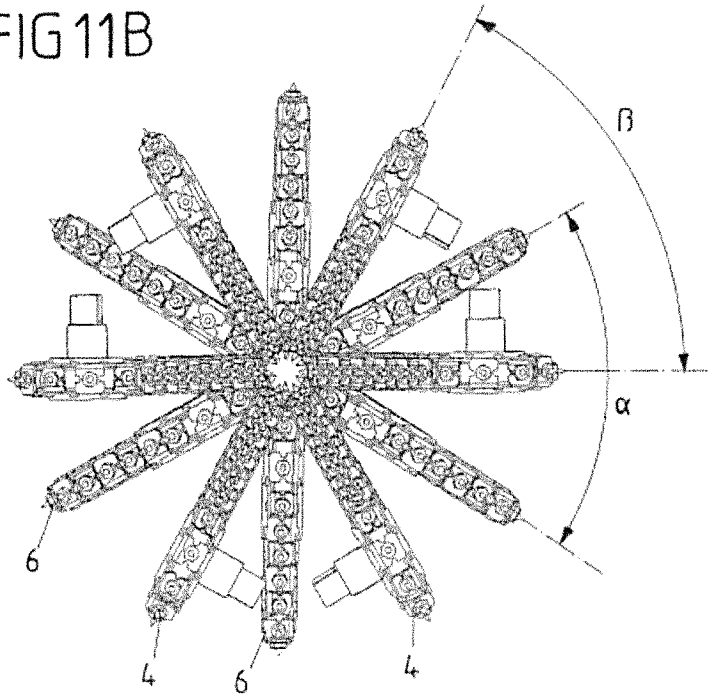
FIG. 11B is a top plan view of the advancing devices of the compacting unit and of the post-compacting unit.
Figure 12:
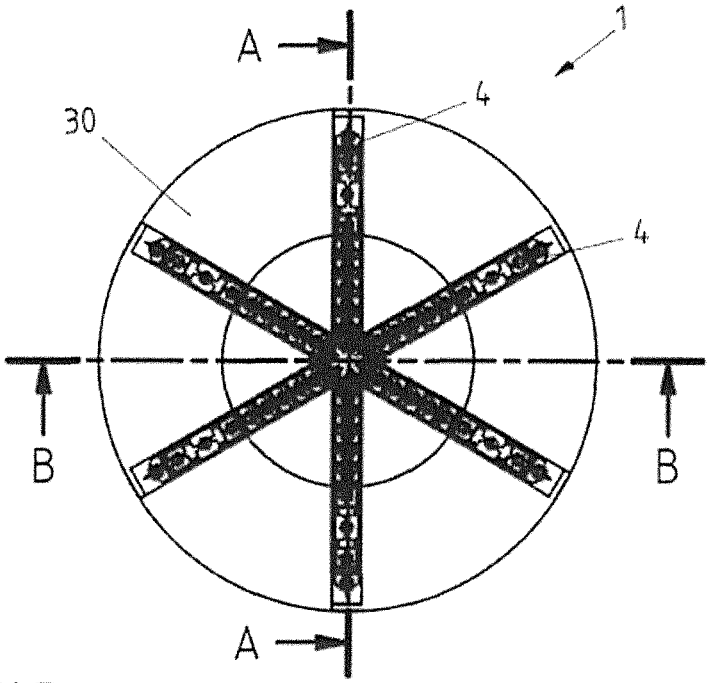
FIG. 12 is a plan view of the compacting apparatus.
Figure 13A:
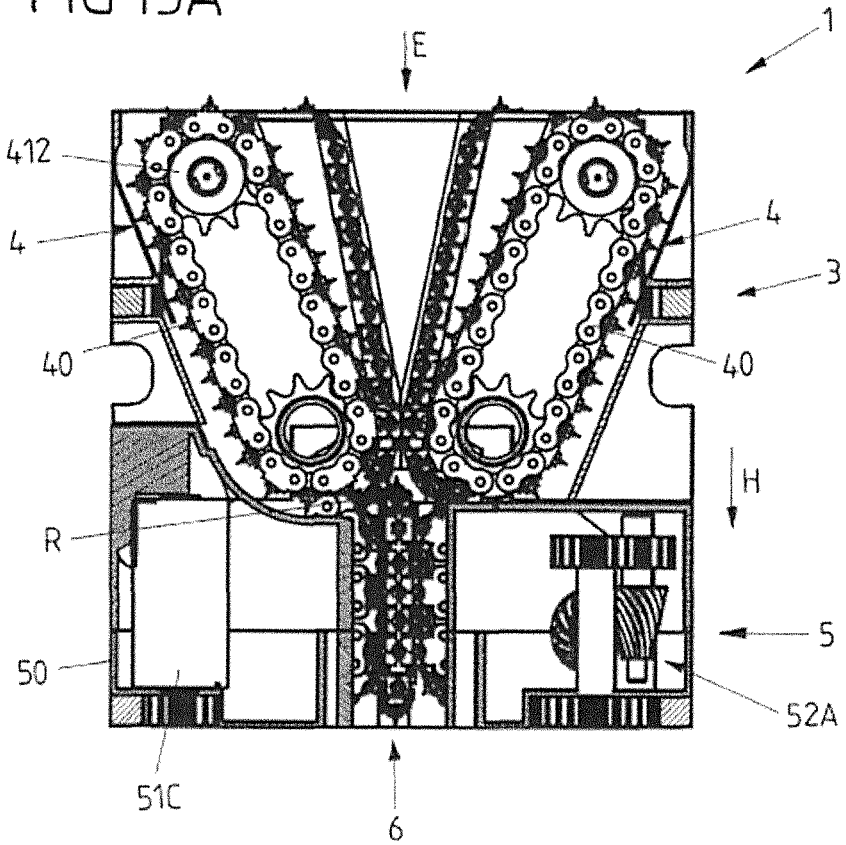
FIG. 13A is a cross-sectional view taken along the line A-A in FIG. 12.
Figure 13B:
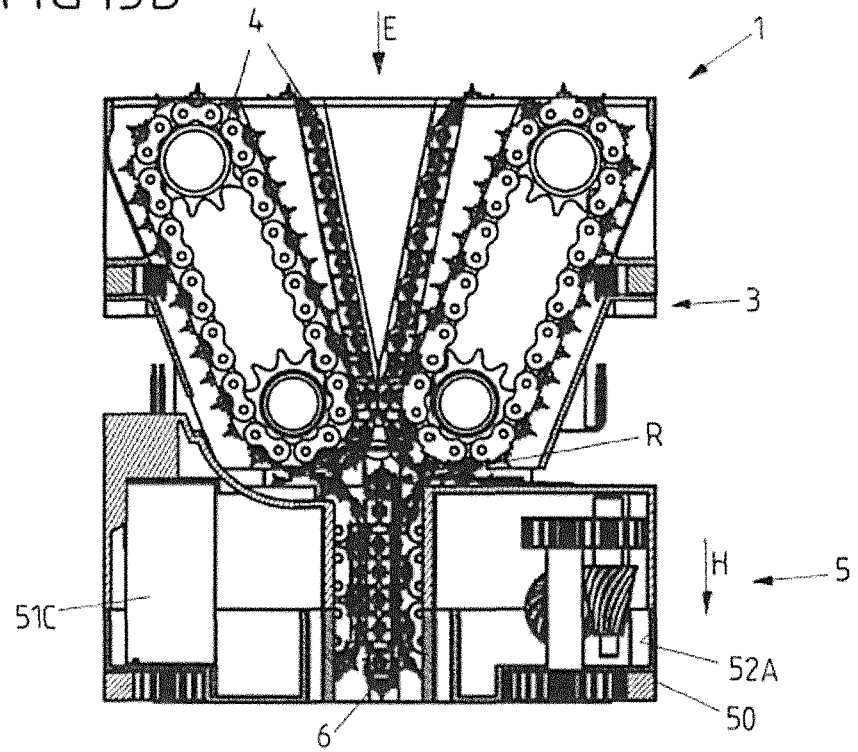
FIG. 13B is a cross-sectional view taken along the line A-A in FIG. 12, with the post-compacting unit in an adjusted state.
Figure 13C:
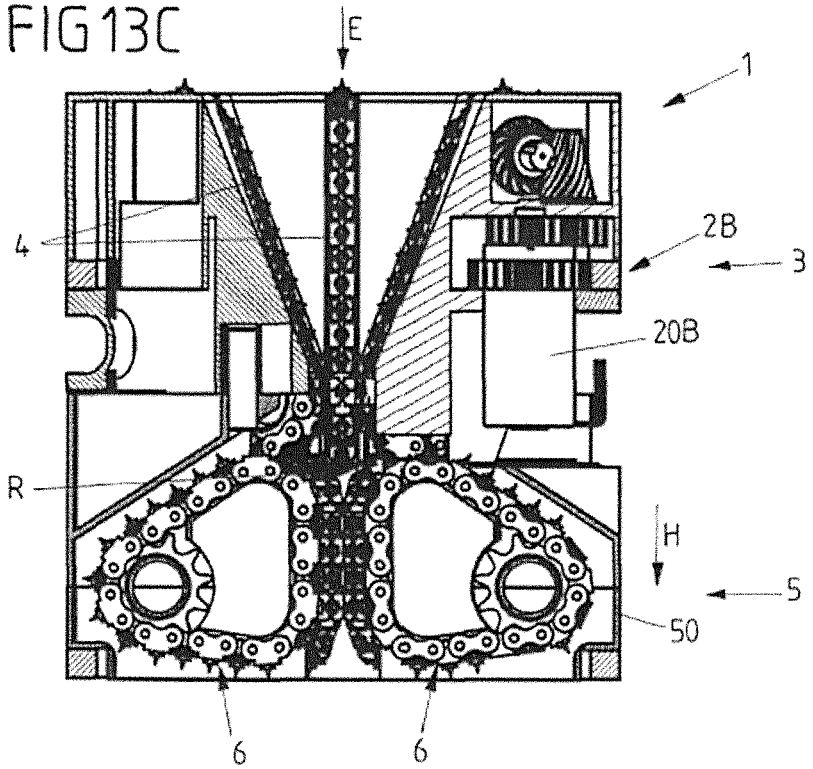
FIG. 13C is a cross-sectional view taken along the line B-B in FIG. 12.

As illustrated in FIGS. 11A and 11B, the advancing devices 6 of the post-compacting unit 5 are at an angle $\alpha$ to one another, while the advancing devices 4 of the compacting unit 3 are arranged at an angle $\beta$ to one another. The advancing devices 6 of the post-compacting unit 3 are arranged in a staggered manner along the angle bisector between the advancing devices 4 of the compacting unit 3. This results, in the illustrated example having six advancing devices 6 of the post-compacting unit 5 and six advancing devices 4 of the compacting unit 3, in an angular spacing $\alpha$ of 60° between the advancing devices 6 of the post-compacting unit 5 and an angular spacing $\beta$ of likewise 60° between the advancing devices 4 of the compacting unit 3, wherein there is an angular offset of 30° between the advancing devices 6 of the post-compacting unit 5 and the advancing devices 4 of the compacting unit 3.

On account of the angular offset between the advancing devices 6 of the post-compacting unit 5 and the advancing devices 4 of the compacting unit 3, the volume of the compression space R between the advancing devices 4 of the compacting unit 3 and the advancing devices 6 of the post-compacting unit 5 can be comparatively small in a starting state, because the chains of the advancing devices 4 of the compacting unit 3 and of the advancing device 6 of the post-compacting unit 5 can move independently of one another without impeding one another.

Arranged on the chain links 400, 600 (see FIG. 8 and FIG. 10B) that form the chains of the chain drives 40, 60 are in each case piercing tools 401, 601 in the form of spikes, which serve to come into engagement with a receptacle G inserted into the compacting unit 3 and to at least partially perforate the receptacle G. The piercing tools 401 serve in this case not only to transmit their advancing movement in a suitable manner to the receptacle G but also to perforate the receptacle G such that air can escape from the interior of the receptacle G and the receptacle G can be compacted effectively.

In the exemplary embodiment illustrated, a piercing tool 401 in the form of a spike is arranged on each chain member 400 of each chain of an advancing device 4, 6. However, provision can be made in an advantageous configuration for the chain drives 40 of the advancing devices 4 of the compacting unit 3 to carry a piercing tool 401 only on every second chain link 400, for example on each outer link, while the chain drives 60 of the advancing devices 6 of the post-compacting unit 5 have a piercing tool 601 in the form of a spike on each chain link 600. The density of the piercing tools 401, 601 is thus greater on the advancing devices 6 of the post-compacting unit 5 than on the advancing devices 400 of the compacting unit 3. This can have the advantageous effect that, on account of the increased speed V1 of the advancing devices 4 of the compacting unit 3, the piercing tools 401 do not bring about excessive destruction of the receptacle G upon conveying into the compression space R, and the advancing devices 6 of the post-compacting unit 5 can transport the receptacle G efficiently out of the compression space R.

In order to further increase the efficiency of compacting with the compacting unit 3 and the post-compacting unit 5 interacting, the compacting unit 3 and the post-compacting unit 5 are adjustable relative to one another vertically in a stroke direction H (see FIGS. 13A and 13B) in the insertion direction E. Advantageously, in this case the compacting unit 3 can be kept in a fixed position while the position of the post-compacting unit 5 is changeable with respect to the compacting unit 3 in the stroke direction H. However, it is also possible in principle for the compacting unit 3 to be adjustable rather than the post-compacting unit 5 or in addition to the post-compacting unit 5.

Figure 16:
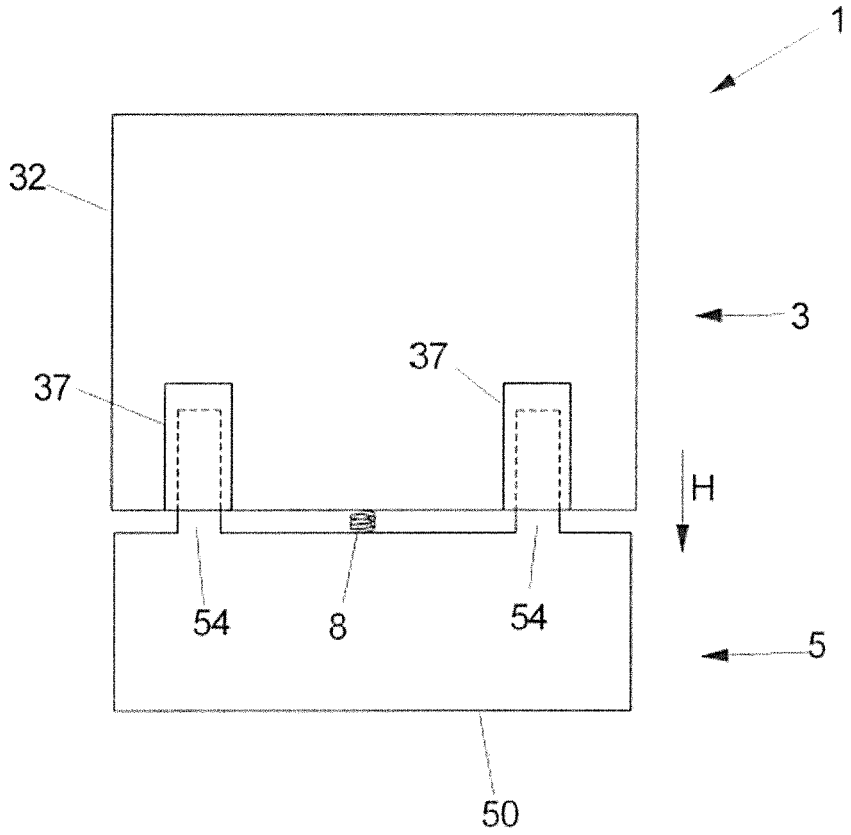
FIG. 16 is a schematic view of the compacting unit and of the post-compacting unit illustrating the changeability of position.

As a result of the adjustability of the compacting unit 3 and of the post-compacting unit 5 with respect to one another, the positions of the compacting unit 3 and of the post-compacting unit 5 with respect to one another can be changed during a compacting operation. To this end, the housing 32 of the compacting unit 3 is guided longitudinally on the housing 50 of the post-compacting unit 5 along guide pins 54 (see FIGS. 6A and 16) that engage in guide bushings 37, such that the positions of the compacting unit 3 and of the post-compacting unit 5 are changeable with respect to one another in a defined manner.

In a starting position, the post-compacting unit 5 is in the vicinity of the compacting unit 3 such that the compression space R between the advancing devices 4 of the compacting unit 3 and the advancing devices 6 of the post-compacting unit 5 has a minimum volume. The post-compacting unit 5 is pretensioned in the direction of this starting position relative to the compacting unit 3 by means of a pretensioning unit 8 (illustrated schematically in FIG. 16), such that following a deflection out of the starting position, the post-compacting unit 5 is also restored automatically to its starting position.

During a compacting operation, a receptacle G is conveyed through the compacting unit 3 and pushed into the compression space R between the compacting unit 3 and the post-compacting unit 5. Because the advancing devices 6 of the post-compacting unit 5 run at a reduced speed V2 compared with the advancing devices 4 of the compacting unit 3, this results in compression of the receptacle G in the compression space R, this having the effect that the receptacle G is pressed successively into the compression space R. If the volume of the receptacle G pressed into the compression space R is greater than the capacity of the compression space R in the starting position of the post-compacting unit 5, the post-compacting unit 5 is adjusted relative to the compacting unit 3 in the stroke direction H counter to the spring-elastic pretensioning force of the pretensioning device 8 and thus deflected out of its starting position. This makes it possible for the receptacle G—regardless of its wall thickness—to be able to be conveyed completely into the compression space R and in the process to be compacted effectively on account of the conveying action of the advancing devices 4 and of the compressive action in the compression space R. The compacted receptacle G is then conveyed in a retarded manner out of the compression space R by means of the advancing devices 6 of the post-compacting unit 5 and is ejected from the compacting apparatus 1 as a compacted receptacle G" (see FIG. 1).

Receptacles G" which are ejected from the post-compacting unit 5 have a sphere-like shape. This has the advantage that receptacles G" compacted in this way have a good bulk handling and layering behavior. In particular, the outer surface of the receptacles G" is approximately smooth and so the risk of catching with other receptacles G"—which would impair the bulk handling behavior—is small.

The control device 7 can also effect intelligent control.

For example, when a receptacle G is stuck in the compacting unit 3, the control device 7 can cause the advancing devices 4 of the compacting unit 3 to be automatically driven in the reverse direction of movement, such that a receptacle G can be ejected from the compacting unit 3 again. If, by contrast, it is established that a receptacle G has passed through the compacting unit 3 and has been pressed into the compression chamber R, but in the process excessive deflection of the post-compacting unit 5 (for example beyond a predetermined threshold value) occurs, then the conveying speed V2 of the post-compacting unit 5 can be equalized with the conveying speed V1 of the compacting unit 3 such that the receptacle G is conveyed readily and in particular without further compression out of the post-compacting unit 5.

Furthermore, it is also conceivable for the control device 7 to actuate the post-compacting unit 5 so that the advancing devices 6 of the post-compacting unit 5 are driven only when a deflection of the post-compacting unit 5 occurs on account of compression of a receptacle G in the compression space R. The compacting unit 3 thus conveys a receptacle G into the compression space R with the advancing devices 6 of the post-compacting unit 5 initially at a standstill. Only after the post-compacting unit 5 has been deflected in the stroke direction H are the advancing devices 6 set into movement and thus the compacted receptacle G conveyed out of the compression space.

The chain drives 40 of the advancing devices 4 of the compacting unit 3 and also the chain drives 60 of the advancing devices 6 of the post-compacting unit 5 are—in the case of the advancing devices 4 of the compacting unit 3—mounted between sprockets 412 or—in the case of the advancing devices 6 of the post-compacting unit 5—guided on a guide element 62. In order in this case to ensure that the chain tension of the chain drives 40, 60 is always sufficiently high, a means for length compensation in order to readjust the chain tension can be provided on each chain drive 40, 60.

Thus, on each chain drive 40 of the advancing devices 4 of the compacting unit 3, provision can be made of a guide element 46 which has two portions 461, 462 that are pretensioned in a spring-elastic manner with respect to one another via a pretensioning device 463, said portions causing a tension in the chain drive 40 and achieving automatic re-tensioning if a chain drive 40 elongates. The chain drive 40 thus always has a sufficiently high tension.

In an analogous manner, on each chain drive 60 of the advancing devices 6 of the post-compacting unit 5, the guide element 62 can also have two portions 621, 622 which are pretensioned with respect to one another via a pretensioning device 623 and thus effect automatic re-tensioning of the chain drive 60 if the chain elongates during operation.

The pretensioning devices 463, 623 can be designed such that it is only possible to move the respective portions 461, 462, 621, 622 away from one another, but not to restore the distances 461, 462, 621, 622 from one another. The portions 461, 462 and 621, 622 can thus only be moved away from one another, but cannot be moved back towards one another after re-tensioning of the chain drive 40, 60 has taken place. Such length compensation apparatuses are well known, for example as cable length compensation apparatuses in cable window regulators in motor vehicles.

The idea underlying the invention is not limited to the exemplary embodiments outlined above, but can also be realized in principle in embodiments of entirely different types.

Thus, in particular the advancing devices do not necessarily need to be configured as chain drives. It is also conceivable to use for example, for the advancing devices of the compacting unit and of the post-compacting unit, advancing devices that make use of belts, bands or cables or other traction members for transmitting tractive forces.

Likewise, the compacting unit and the post-compacting unit can in principle also have a different number of advancing devices.

Also, the number of advancing devices of the compacting unit and the number of advancing devices of the post-compacting unit are not necessarily identical. The compacting unit and the post-compacting unit can in principle also have a different number of advancing devices.

In addition, other configurations of drive apparatuses are also conceivable. For example, the compacting unit and the post-compacting unit may each have only one single drive apparatus, although it is in principle also conceivable for the compacting unit and the post-compacting unit to use a common drive apparatus.

LIST OF REFERENCE SIGNS

1 Compacting apparatus
2A Drive apparatus
20A Electric motor
21A Drive shaft
22A, 23A Gear wheel
24A Bevel wheel
25A Toothed wheel
26 Ring gear
3 Compacting unit
30 Cover plate
300 Insertion opening
31 Bottom
32 Housing
34 Bearing plates
36 Guide surface
37 Bearing bushing
4 Advancing device
40 Chain drive
400 Chain link
401 Piercing tool (Spike)
41 Shaft
410 Bevel wheel
412 Sprocket
46 Guide element

461, 462 Portion
463 Pretensioning device
5 Post-compacting unit
50 Housing
51A, 51B, 51C Drive apparatus
510A, 510B, 510C Drive wheel
511A, 511B, 511C Electric motor
52A, 52B, 52C Drive train
520A, 520B, 520C Toothed wheel
521A Shaft
522A, 523A Toothed wheel
524A Shaft
525A Bevel wheel
53 Ring gear
54 Guide pin
6 Advancing device
60 Chain drive
600 Chain link
601 Piercing tool (Spike)
602 Sprocket
61 Shaft
610 Bevel wheel
62 Guide element
620 Guide track
621, 622 Portion
623 Pretensioning device
7 Control device
8 Pretensioning device
α, β Angle
A1, A2 Cross-sectional area
G" Post-compacted receptacle
H Stroke direction
M Lateral surface
R Compression space
S Rotation axis
T Hopper
V, V' Advancing direction
V1, V2 Conveying speed

The invention claimed is:

1. A compacting apparatus for compacting receptacles, comprising:

a compacting unit having at least one first advancing device for transporting at least one receptacle in an insertion direction, the compacting unit being configured to compact the at least one receptacle while the at least one receptacle is being transported in the insertion direction;

a post-compacting unit arranged downstream of the compacting unit in the insertion direction, said post-compacting unit having at least one second advancing device for transporting the at least one receptacle through the post-compacting unit, wherein the post-compacting unit is configured to compact the at least one receptacle further, wherein positions of the at least one first advancing device of the compacting unit and of the at least one second advancing device of the post-compacting unit are changeable with respect to one another in the insertion direction; and wherein the compacting unit has a first housing on which the at least one advancing device is arranged, and the post-compacting unit has a second housing on which the at least one second advancing device is arranged, wherein the positions of the first housing and the second housing are changeable with respect to one another in the insertion direction.

2. The compacting apparatus of claim 1, wherein the first housing of the compacting unit and the second housing of the post-compacting unit are guided longitudinally together in the insertion direction.

3. The compacting apparatus of claim 1, further comprising a spring-elastic pretensioning device which pretensions the first housing and the second housing against changing position with respect to one another in the insertion direction.

4. The compacting apparatus of claim 1, wherein the at least one first advancing device of the compacting unit and the at least one second advancing device of the post-compacting unit form a compression space between one another, wherein the at least one first advancing device of the compacting unit is configured to convey the at least one receptacle into the compression space, and the at least one second advancing device of the post-compacting unit is configured to convey the at least one receptacle out of the compression space, and a size of the compression space is changeable by changing the position of the at least one first advancing device and of the at least one second advancing device with respect to one another.

5. The compacting apparatus of claim 1, further comprising a control device, wherein the at least one first advancing device of the compacting unit is operable at a first conveying speed for conveying the at least one receptacle and the at least one second advancing device of the post-compacting unit is operable at a second conveying speed for conveying the at least one receptacle and the control device is configured to control the first conveying speed and the second conveying speed.

6. The compacting apparatus of claim 1, further comprising a first drive apparatus for driving the at least one first advancing device and a second drive apparatus, different than the first drive apparatus, for driving the at least one second advancing device.

7. The compacting apparatus of claim 6, wherein the first drive apparatus is operatively connected to a plurality of first advancing devices in order to synchronously drive the first advancing devices and/or the second drive apparatus is operatively connected to a plurality of second advancing devices in order to synchronously drive the second advancing devices.

8. A compacting apparatus for compacting receptacles, comprising:

a compacting unit having at least one first advancing device for transporting at least one receptacle in an insertion direction, the compacting unit being configured to compact the at least one receptacle while the at least one receptacle is being transported in the insertion direction, and a post-compacting unit arranged downstream of the compacting unit in the insertion direction, said post-compacting unit having at least one second advancing device for transporting the at least one receptacle through the post-compacting unit, wherein the post-compacting unit is configured to compact the at least one receptacle further, wherein positions of the at least one first advancing device of the compacting unit and of the at least one second advancing device of the post-compacting unit are changeable with respect to one another in the insertion direction;

wherein the at least one first advancing device and the at least one second advancing device are arranged in an offset manner with respect to one another in a circumferential direction around the insertion direction.

9. The compacting apparatus of claim 1, wherein the at least one first advancing device of the compacting unit is configured to convey the at least one receptacle for compacting into a hopper formed by the compacting unit.

10. The compacting apparatus of claim 9, wherein the compacting unit has plural advancing devices arranged in a circumferential direction around the insertion direction around the hopper.

11. The compacting apparatus of claim 1, wherein the at least one first advancing device of the compacting unit is formed by a chain drive formed from chain links, wherein the chain drive is configured to move in an advancing direction along an outer lateral surface of a hopper during operation of the compacting apparatus such that the at least one receptacle is conveyed into the hopper in the insertion direction.

12. The compacting apparatus of claim 1, wherein the at least one second advancing device of the post-compacting unit is formed by a chain drive formed from chain links, wherein the chain drive is configured to transport the at least one receptacle further in the insertion direction.

13. The compacting apparatus of claim 1, further comprising at least one piercing tool for piercing the at least one receptacle, the piercing tool being arranged on the at least one first advancing device and/or on the at least one second advancing device.

14. The compacting apparatus of claim 13, wherein the at least one piercing tool comprises plural piercing tools arranged respectively on every second chain link on the at least one first advancing device, which is formed by a chain drive having chain links, while a piercing tool (601) is arranged on every chain link on the at least one second advancing device, which is formed by a chain drive having chain links.

* * * * *